United States Patent [19]

Kovacs et al.

[11] Patent Number: 4,484,953

[45] Date of Patent: Nov. 27, 1984

[54] METHOD OF MAKING DUCTILE CAST IRON WITH IMPROVED STRENGTH

[75] Inventors: Bela V. Kovacs; Roman M. Nowicki, both of Bloomfield Hills; Charles A. Stickels, Ann Arbor, all of Mich.

[73] Assignee: Ford Motor Company, Dearborn, Mich.

[21] Appl. No.: 474,655

[22] PCT Filed: Jan. 24, 1983

[86] PCT No.: PCT/US83/00114

§ 371 Date: Jan. 24, 1983

§ 102(e) Date: Jan. 24, 1983

[87] PCT Pub. No.: WO84/02925

PCT Pub. Date: Aug. 2, 1984

[51] Int. Cl.[3] ..... C21D 5/00; C22C 37/10

[52] U.S. Cl. ..... 148/3; 75/123 CB; 75/123 L; 148/35; 148/139

[58] Field of Search ..... 148/3, 35, 138–141; 75/123 CB, 123 L

[56] References Cited

U.S. PATENT DOCUMENTS

| | | | |
|---|---|---|---|
| 2,324,322 | 7/1943 | Reese et al. | 148/35 |
| 3,549,430 | 12/1970 | Kies et al. | 148/35 |
| 3,600,159 | 8/1971 | Moore et al. | 75/123 CB |
| 3,673,004 | 6/1972 | Dumitrescu | 75/123 CB |
| 3,702,269 | 11/1972 | Church | 148/35 |

FOREIGN PATENT DOCUMENTS

| | | | |
|---|---|---|---|
| 133420 | 10/1979 | Japan | 148/139 |
| 30453 | 10/1981 | Japan | 75/123 CB |
| 27747 | 10/1981 | Japan | 148/35 |
| 131321 | 8/1982 | Japan | 148/139 |
| 753923 | 8/1980 | U.S.S.R. | 148/139 |

*Primary Examiner*—Peter K. Skiff

*Attorney, Agent, or Firm*—Joseph W. Malleck; Olin B. Johnson

[57] ABSTRACT

A method of making ductile cast iron with a matrix of acicular ferrite and bainite is disclosed. A melt by weight of 3.0–3.6% carbon, 3.5–5.0% silicon, 0.7–5.0% nickel, 0–0.3% Mo, >0.015% S, >0.06% P (remainder Fe) is subjected to a nodularizing agent and solidified. The iron is then heat treated by heating to 1575°–1650° F. for 1–3 hours, quenched to 400°–775° F. at a rate of at least 275° F./min., held for 0.5–4 hours, and cooled to room temperature. The resulting ductile iron exhibits a yield strength of at least 80 ksi, a tensile strength of at least 140 ksi, elongation of at least 6%, and a hardness of at least 270 BHN.

9 Claims, 2 Drawing Figures

METHOD OF MAKING DUCTILE CAST IRON WITH IMPROVED STRENGTH

BACKGROUND OF THE INVENTION AND PRIOR ART STATEMENT

Ductile cast iron, also known as nodular iron or spherulitic iron, is cast iron in which the graphite is present as tiny balls or spherulites, instead of as flakes normally present in grey iron, or instead of compacted aggregates present in malleable iron.

The composition of unalloyed ductile iron is similar to that of grey iron, containing similar amounts of carbon, silicon, manganese, and phosphorus. The spheroidal graphite structure is produced by the addition of one or more elements to the molten metal, such elements commonly being referred to as nodularizing agents; on a commercial basis the agent is magnesium and/or cerium.

Ductile iron can be produced as-cast, or given an annealing treatment such as a ferritizing anneal, or can be quenched and tempered. The microstructure of as-cast ductile iron is pearlitic in the matrix along with a small amount of cementite, and has considerable ferrite surrounding each graphite nodule (commonly referred to as a bulls-eye ferrite configuration). The relative amounts of pearlite, ferrite, and cementite are dependent on the composition, type of inoculant, inoculation practice, and, most importantly, the cooling rate.

The microstructure of annealed ductile cast iron, particularly in the case of ferritized annealed cast iron, is a ferrite matrix in which are nestled graphite nodules along with a small or negligible amount of cementite. The microstructure of austempered ductile cast iron is a mixed phase matrix composed of austenite and martensite or bainite (see U.S. Pat. Nos. 2,324,322 and 3,860,457). The microstructure of quenched and tempered ductile iron is tempered martensite and/or bainite (see U.S. Pat. No. 3,702,269).

Each of these types of ductile cast iron microstructures leaves something to be desired in terms of the total combination of physical characteristics. For example, in a conventional as-cast ductile iron the yield strength is typically about 60 ksi, the tensile strength is about 80 ksi, accompanied by an elongation of about 3%. This type of iron is not particularly strong nor is it particularly ductile. An annealed ductile cast iron, particularly one having been subjected to a ferritizing anneal, will have a yield strength of about 40 ksi, a tensile strength of 60 ksi, and an elongation of 10–18%. This latter iron is not particularly strong, although excellent is ductility. A conventional quenched and tempered ductile cast iron will typically have a yield strength of about 90 ksi, a tensile strength of 120 ksi, and an elongation of 2% or less. The quenched and tempered ductile iron is exceptionally strong but poor in ductility.

What is needed by the prior art is a method and ability to produce ductile iron with an improved combination of physical characteristics, including a yield strength of at least 80 ksi, a tensile strength of at least 140 ksi, an elongation of 6–10% as well as exceptional hardness in the range of 275–290 BHN.

SUMMARY OF THE INVENTION

The invention is an improved method of making a ductile cast iron (and an improved casting iron composition), the ductile cast iron having a microstructure with a matrix consisting of acicular ferrite and bainite, said cast iron exhibiting an elongation of 6–10%, a yield strength of at least 80,000 psi, and tensile strength of at least 140,000 psi.

The process comprises: (a) forming a ductile cast iron by melting a ferrous alloy consisting essentially of by weight 3.0–3.6% carbon, 3.5–5.0% silicon, 0.7–5.0% nickel, 0–0.3% molybdenum, 0.2–0.4% manganese, less than 0.015% sulphur and 0.06% phosphorus, the remainder essentially iron, said melt being subjected to a nodularizing agent for effecting graphitic aggregates upon cooling and solidification to form said ductile cast iron; (b) heating said ductile cast iron to 1575°–1650° F. for a period of 1–3 hours and immediately quenching to 400°–775° F. at a rate of at least 275° F./min.; and (c) holding the ductile cast at said latter temperature for a period of 0.5–4 hours followed by cooling to room temperature.

The resulting ductile cast iron has a matrix consisting of ferrite and upper bainite. It is preferred that the silicon content of the melt be corrolated with the temperature of heat treatment so that the silicon concentration in the cast iron is present in microripples along the matrix. It is preferred that such silicon microconcentration gradient provide a silicon content in the ferrite which is at least 1.5% by weight greater than the silicon content in the upper bainite. This can be promoted by using a nodularzing agent with a particle size of about ¼–1/6 inch diameter thereby insuring silicon segregation ripples. It is also preferred that the chemistry of the melt be 3.6% carbon, 4.0% silicon, 1.3% nickel, 0.30% molybdenum, and 0.2% manganese.

It is advantageous if the heating of steps (b) and (c) employ an austenizing temperature of 1600° F. in step (b), followed by quenching in a salt bath, and the holding temperature of step (c) is 725° F. with cooling carried out in a vermiculite for a period of 3 hours.

The composition of the present invention is ferritic/-bainitic ductile cast iron consisting essentially of 3.0–3.6% by weight carbon, 3.5–5.0% silicon, 0.7–5.0% nickel, 0–0.3% molybdenum, 0.2–0.4% manganese, less than 0.06% phosphorus and 0.015% sulphur, 0.02–0.06% nodularizing agent, and the remainder essentially iron. The matrix structure of the composition preferably consists of 70–85% bainite, 15–30% ferrite, and 1–2% massive austenite. The composition has a tensile strength of at least 140 ksi, a yield strength of at least 80 ksi, an elongation of 6–10%, and a hardness of at least 275 BHN.

DETAILED DESCRIPTION

Figure 2:
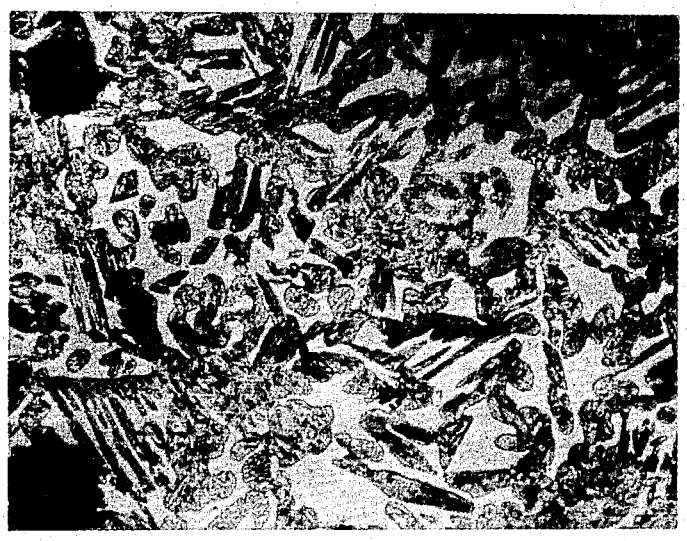
FIG. 2 is a microphotograph (500× magnification) of the heat treated material of this invention showing a microstructure of silico-ferrite and upper bainite.
Figure 1:
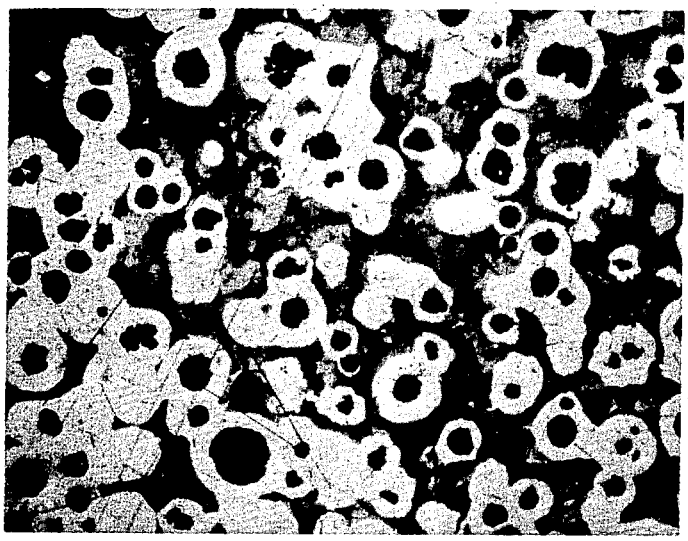
FIG. 1 is a microphotograph of a ductile iron as-cast (not heat treated) using the chemistry of this invention (100× magnification)

A preferred process for carrying out the invention for making a ductile cast iron having a microstructure with the matric thereof consisting of ferrite and upper bainite, is as follows.

Melting

Before the nodularizing treatment, the base composition of a ferrous melt, intended for conversion to nodular iron, is made up of proper proportions of steel and cast scrap and various grades of pig iron. The ferrous components of the melt must be low in phosphorus, chromium, titanium, copper, lead, and other nonferrous metals that inhibit graphitization, as well as certain alloying elements commonly added to iron and steel. The conventional melt for making nodular cast iron typically is comprised by weight percent of 3.0–3.8% carbon, 2.4–2.6% silicon, 0.6–0.7% manganese, sulphur limited to no more than 0.015%, and phosphorus limited to 0.06%.

With this invention the ferrous based alloy is adjusted to have 3.0–3.6% carbon (preferably 3.2% carbon), 3.5–5.0% silicon (preferably 4.0%), 0.7–5.0% nickel (preferably 1.3% nickel), 0–0.3% molybdenum, 0.2–0.4% manganese, along with the conventional maximum limits of phosphorus and sulphur, the remainder being substantially iron.

The sulphur may be controlled by using base materials low in sulphur, by desulphurizing the melt, or by a combination of both. Any melting unit can be used for producing nodular iron if good control of the temperature and composition of the melt is maintained. Facilities commonly employed are: (a) cupola melting with either an acid or basic slag, (b) duplex melting in an acid or basic cupola followed by melting in an acid or basic electric arc furnace where adjustment in composition is made, after which the temperature of the melt is raised for treatment with the magnesium alloy, and (c) acid or basic electric arc melting.

Melt temperature is of major importance in the production of sound castings with good mechanical properties in the as-cast condition. Optimum temperature is influenced by the section thickness of the casting to be poured, the melting equipment and metal distribution to the molds, the method for adding magnesium and other innoculants, and the gating system used.

The chemical limits on variation of the nodular iron melt makeup is important. For example, with the silicon chemical range limit of 3.5–5.0, melts using silicon below 3.5 will (a) produce bulls-eye ferrite and not the mixed ferrite/bainite structure desired of this invention, and (b) have the ductility severely reduced by increased bainite. If the silicon content exceeds 5.0%, the composition will not have sufficient strength due to embrittlement by excessive silicon. But, more importantly, the material will be difficult to heat treat by the narrowing of the austenitizing range and the requirement for undesirably closer temperature control. Moreover, the fatigue qualities of this material will go down considerably.

If the nickel content is below the required amount, the matrix structure will exhibit some pearlite accompanied by some bainite, significantly reducing strength and ductility. Elongation is reduced to 2–3% with reduction of other mechanical properties. If the nickel content exceeds 3%, the processing of the material becomes exceedingly expensive even though the mechanical properties of the composition are not injured.

The use of molybdenum in excess of 0.3% by weight results in segregation of the molybdenum and thereby causes undesirable morphology of the ferritic phase.

Spheroidal graphite can be produced by the addition of one or more elements to the molten metal, including: magnesium, cerium, calcium, lithium, sodium, barium, etc.; the only two that are of importance to this specification are magnesium and cerium because they are commercially available and used. Of the two, magnesium is used more frequently and is usually added as an alloy consisting of (a) iron/silicon/magnesium, (b) nickel/iron/silicon/magnesium, (c) nickel/magnesium, or other combinations. The magnesium can be exposed to the melt by any of several methods. In industry today ladle treatment and in-the-mold treatment is used, but pressure ladle methods or immersion refractory baskets are also available.

Heat Treatment

The nodular cast iron upon solidification and cooling is heat treated in two stages, the first being to heat to a temperature of 1575°–1650° F. for a period of 1–3 hours, preferably 2 hours. This heating is essentially austenization during which a mixed phase of austenite and ferrite is formed at such temperature. In the second stage the iron is immediately quenched to a temperature level of 400°–775° F. at a rate of at least 275° F. per minute, preferably in a salt bath. It is held at this temperature for a period of 0.5–4 hours followed by cooling (preferably slow cooling) to room temperature at a rate of equal to or less than 35° F. per minute, preferably in vermiculite to prevent martensite transformation. The resulting iron contains the unique combination of both ferrite and bainite. This is an unobvious result since the prior art recognizes that slow cooling is necessary to obtain ferrite, while fast cooling is necessary to obtain bainite. The seemingly inconsistent goals have been simultaneously achieved by unusual chemistry along with processing.

Test samples were prepared and heat treated to illustrate the chemistry and processing limits of this invention. The data generated is shown in Table I. All samples contained 3.0–3.6% by weight carbon, and less than 0.06 phosphorus and 0.015 sulphur. Each ductile iron was strong (at least 80 ksi yield strength, at least 140 ksi tensile strength) and ductile (at least 6% elongation).

TABLE I

| Sample | Si | Ni | Mo | Mn | Austenitizing Heat Treatment (1575–1650° F. for 1–3 Hours | Quench Rate minute (275° F./min.) | Temperature 675–750° F. for .4–5 Hours | Ferrite-Bainite Microstructure |
|---|---|---|---|---|---|---|---|---|
| 1 | 4.0 | 1.3 | .2 | .3 | Yes | Yes | Yes | Yes |
| 2 | 2.6 | 1.3 | .2 | .3 | Yes | Yes | Yes | No |
| 3 | 4.0 | 1.3 | .2 | .3 | Yes | Yes | Yes | Yes, but low strength |
| 4 | 4.0 | .4 | .2 | .3 | Yes | Yes | Yes | No |
| 5 | 4.0 | 4.0 | .2 | .3 | Yes | Yes | Yes | Yes, but too expensive to make |
| 6 | 4.0 | 1.3 | .2 | .3 | Yes | No | Yes | No (Pearlite) |
| 7 | 4.0 | 1.3 | .2 | .3 | Yes | Yes | No (below range) | No (insufficient ferrite) |

TABLE I-continued

| Sample | Si | Ni | Mo | Mn | Austenitizing Heat Treatment (1575-1650° F. for 1-3 Hours | Quench Rate minute (275° F./min.) | Temperature 675-750° F. for .4-5 Hours | Ferrite-Bainite Microstructure |
|---|---|---|---|---|---|---|---|---|
| 8 | 4.0 | 1.3 | .2 | .3 | Yes | Yes | No (above range) | No (ferrite/martensite) |

We claim:

1. A method of making a ductile cast iron having a microstructure with a matrix consisting of ferrite and bainite, said cast iron exhibiting a tensile strength of at least 140 ksi, a yield strength of at least 80 ksi, and an elongation of 6-10%, the method comprising:

(a) melting a ferrous alloy consisting essentially of by weight 3.0-3.6% carbon, 3.5-5.0% silicon, 0.7-5.0% nickel, 0-0.3% molybdenum, 0.2-0.4% manganese, not greater than 0.06% phosphorus, not greater than 0.015% sulphur, and the remainder essentially iron, said melted ferrous alloy being subjected to a nodularizing agent to form a ductile cast iron upon solidification and cooling;

(b) heat treating said ductile cast iron by heating to 1575°-1650° F. for a period of 1-3 hours and immediately quenching to 675°-750° F. at a rate of at least 275° F./min.; and (c) holding said ductile cast iron in the temperature range of 400°-775° F. for a period of 0.5-4 hours followed by cooling to room temperature.

2. The method as in claim 1, in which said ferrous alloy melt consists of about 3.0 C, 4.0% silicon, 1.3% nickel, 0.3% molybdenum, 0.2% manganese, the remainder being essentially iron.

3. The method as in claim 1, in which said heat treating is carried out by heating in the first stage to about 1600° F. for 2 hours and is immediately quenched to 725° F. and held for a period of about 2 hours before cooling to room temperature.

4. The method as in claim 1, in which the silicon is present in microripples in said ferrous alloy and is present in a critical microconcentration gradient whereby the silicon content in the ferrite is at least 1.5% by weight greater than the silicon content in the bainite.

5. The method as in claim 1, in which said nodularizing agent has an average particle size diameter of ¼-1/6 inch.

6. A ferritic-bainitic ductile cast iron composition, consisting essentially by weight of 3.0-3.6% carbon, 3.5-5.0% silicon, 0.7-5.0% nickel, 0-0.3% molybdenum, 0.2-0.4% manganese, less than 0.06% phosphorus, less than 0.015% sulphur, 0.02-0.06% magnesium, and the remainder essentially iron, said composition being particularly characterized by a microstructure having a matrix with 70-85% bainite, 15-30% acicular ferrite, and 0-2% massive austenite, the graphite nodules being dispersed throughout the matrix.

7. The composition as in claim 6, in which said composition exhibits a tensile strength of at least 140 ksi, a yield strength of at least 80 ksi, an elongation of 6-10%.

8. The composition as in claim 7, in which said composition additionally exhibits a hardness level of at least 270 BHN.

9. A method of making a ductile cast iron having a microstructure with a matrix consisting essentially of ferrite and bainite, said cast iron exhibiting a tensile strength of at least 140 ksi, a yield strength of at least 80 ksi, and an elongation of 6-10%, the method comprising:

(a) melting a ferrous alloy comprising by weight 3.0-3.6% carbon, 3.5-5.0% silicon, 0.2-0.4% manganese, and the remainder essentially iron except for the presence of selected bainite formers and low phosphorus and sulfur, the melted ferrous alloy being subjected to a nodularizing agent to form ductile cast iron upon solidification and cooling;

(b) heat treating said ductile iron by heating to 1575°-1650° F. for a period of 1-3 hours and immediately quenching to 675°-750° F. at a rate of at least 275° F./min; and (c) holding said ductile iron in the temperature range of 400°-775° F. for a period of 0.5-4 hours followed by cooling to room temperature.

* * * * *